United States Patent [19]

Nystrand

[11] 4,205,836

[45] Jun. 3, 1980

[54] METHOD AND APPARATUS FOR ZIG-ZAG FOLDING

[75] Inventor: Ernst D. Nystrand, De Pere, Wis.

[73] Assignee: Paper Converting Machine Company, Green Bay, Wis.

[21] Appl. No.: 967,426

[22] Filed: Dec. 7, 1978

Related U.S. Application Data

[63] Continuation-in-part of Ser. No. 823,350, Aug. 10, 1977, abandoned.

[51] Int. Cl.[2] ..... B65H 45/16

[52] U.S. Cl. ..... 270/73; 270/85

[58] Field of Search ..... 270/73, 39, 79, 82, 270/85

[56] References Cited

U.S. PATENT DOCUMENTS

| | | | |
|---|---|---|---|
| 2,359,417 | 10/1944 | Hand | 270/73 |
| 3,214,162 | 10/1965 | Breidenbach | 270/73 |
| 3,291,477 | 12/1966 | Rehr | 270/39 |
| 3,406,959 | 10/1968 | Ross | 270/73 |
| 3,762,699 | 10/1973 | Wing | 270/73 |
| 3,883,131 | 5/1975 | Anderson | 270/79 |
| 3,902,710 | 9/1975 | Deligt | 270/79 |

*Primary Examiner*—Clifford D. Crowder
*Assistant Examiner*—A. Heinz
*Attorney, Agent, or Firm*—Tilton, Fallon, Lungmus & Chestnut

[57] ABSTRACT

A method and apparatus for zig-zag folding in which a slotted receiving cage along with separator means are provided for exact count separation.

1 Claim, 5 Drawing Figures

3
3
32
35
36
37
31
33
36
35
32
34
28
29
30
15
26
27
11
11'
26
27'
15
23
23'

METHOD AND APPARATUS FOR ZIG-ZAG FOLDING

This is a continuation-in-part of my co-pending application, Ser. No. 823,350 filed Aug. 10, 1977, now abandoned.

BACKGROUND AND SUMMARY OF INVENTION

This invention relates to a method and apparatus for zig-zag folding and, more particularly, constitutes an improvement over my prior U.S. Pat. No. 3,195,882. In that patent, to achieve higher speeds, the tip of the gripper anvil traced an envelope having a greater diameter than the envelope traced by the tucker. This represented a departure from the prior art which itself was improved by my prior U.S. Pat. No. 3,489,406. However, both of these patents deal with mechanically controlled grippers as contrasted to the resilient form of gripper of my U.S. Pat. No. 3,947,013.

The instant invention has to do with the first type of folding wherein the grippers are mechanically controlled. However, notwithstanding the precision ostensibly available from mechanically controlled grippers, it has become increasingly difficult to develop folds at precise locations, i.e., along spaced apart lines of transverse perforation—and, once so folded, there have been difficulties in separating a continuous stream of forms into exact count stacks.

It will be appreciated that a great demand exists for zig-zag folded forms for use in computers. Computers, particularly the print-out mechanisms, have been operating at ever-increasing speeds. Anything that interferes with the achievement of the higher speeds is, of course, undesirable and disadvantageous. One of these undesirable phenomena is that of stack "lean". By this, I refer to the fact that a free-standing stack, when viewed from the side and parallel to the fold lines assumes a parallelogram type of contour rather than the desired rectangle. This can be noted quickly during the process of manufacture but heretofore nothing has been done to correct this without stopping the machine.

I have ascertained that stack "lean " results from alternate forms or folds being longer than those intervening. The length of forms or folds normally is determined by the lines of transverse perforation existing in the sheet, and I have noted that in prior folders, the tucker and gripper about to enter into engagement "hunt" to seek the line of perforation, i.e., the weakest area in the portion of the web being folded. The difference in length between adjacent lines of peroration in adjacent forms may be only of the order of a few thousandths of an inch but it still results in the undesirable stack "lean".

I have ascertained that the undesirable "lean" which can disrupt the operation of the computer print mechanism by virtue of failing feed properly, can be overcome by a slight angular shift of one folding member relative to the other and this during operation so that the results thereof can be immediately ascertained.

Here it will be appreciated that there has been a demand for increasing speeds of production because there has been a shift to single part business forms—the ease and economy with which reeproduction can be made by xerographic type machines making it unnecessary to have multiple part forms. Thus, to maintain a given output of business forms, the forms manufacturer is desirous of operating at higher speeds which is reflected in differential tensions in the web which can result in slight mislocations in the lines of transverse perforation.

The problem of stack "lean" is substantially eliminated through the use of helical mating gears on the folding members whereby very slight angular adjustments can be made "on the fly". Such type of gearing has not been used, to the best of my knowledge, on folding rolls although such gearing has been used in adjusting the mating engagement of perforation rolls.

The instant invention also comprehends improvements in the zig-zag folding operation and apparatus other than merely eliminating stack "lean". When zig-zag folding is to be achieved at high speed, it is important to control the web carefully both before and after folding. In particular, the web fold in exiting from gripping engagement has to "drape" incident to being stacked. At high speeds, the draping or curving of the folded form can be subject to peculiar forces which may upset an entire stack, thereby destroying the utility of a considerable portion of a given production run. This advantageous control is achieved according to the instant invention through the structure and operation of the folding members to eliminate any surplus of paper upstream of the engaged gripping elements during tucking engagement thereof.

Still further, I provide a novel means and operation for controlling the drape incident to stacking and at the same time achieve a novel separation of the stack into constituents of exact count. More particularly, the invention provides a reliable and mechanical means and method for inserting a separator between the folds of a caged stack to burst the web bonds at a predetermined fold line.

Other objects and advantages of the invention may be seen in the details of the ensuing specification.

DETAILED DESCRIPTION

The invention is described in conjunction with an illustrative embodiment in the accompanying drawing, in which FIG. 1 is a fragmentary elevational view of the folding and stacking portion of a business form producing machine;

Figure 1:
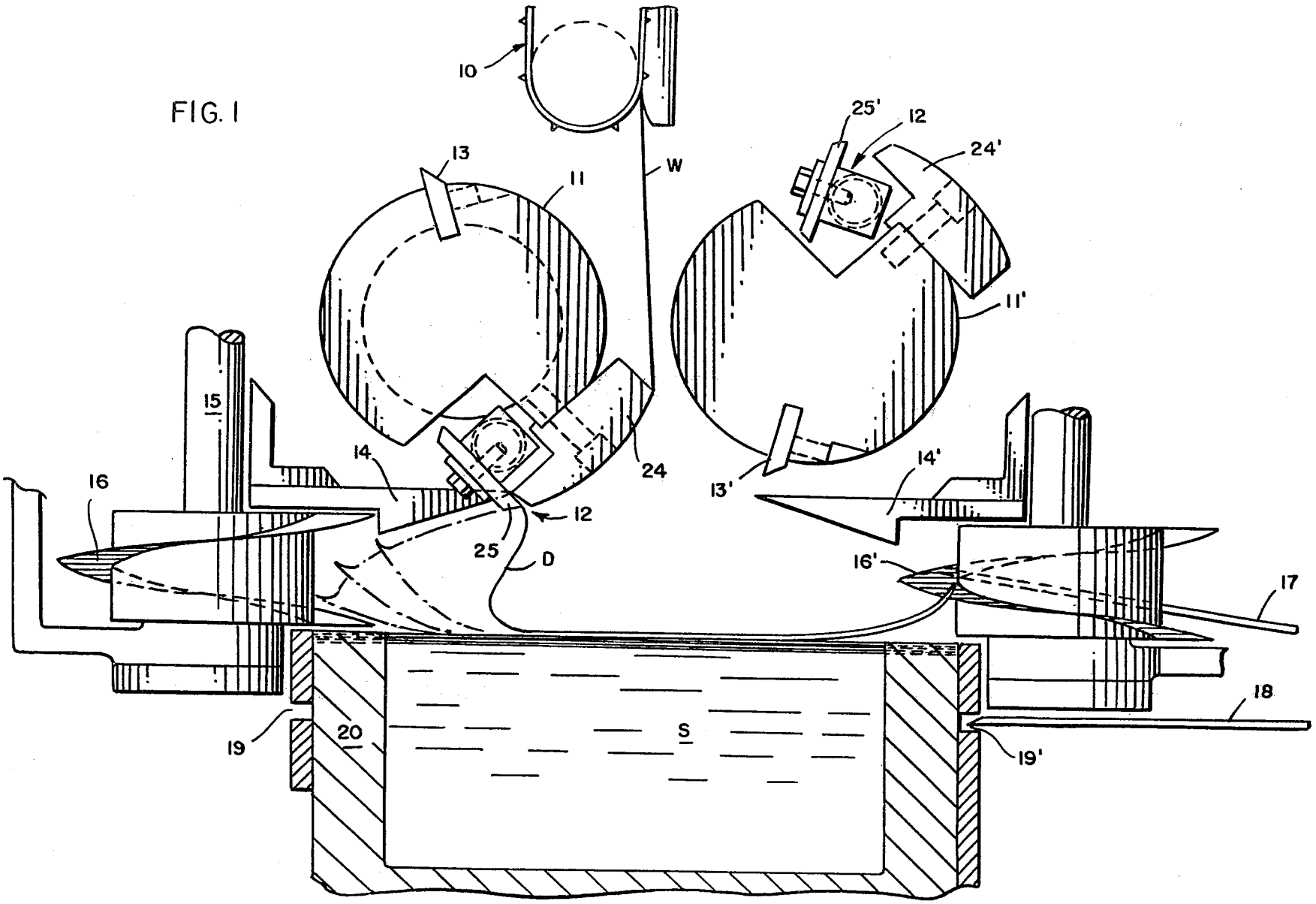
Figure 4:
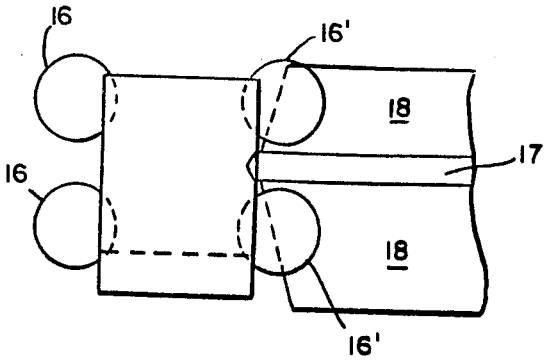
Figure 5:
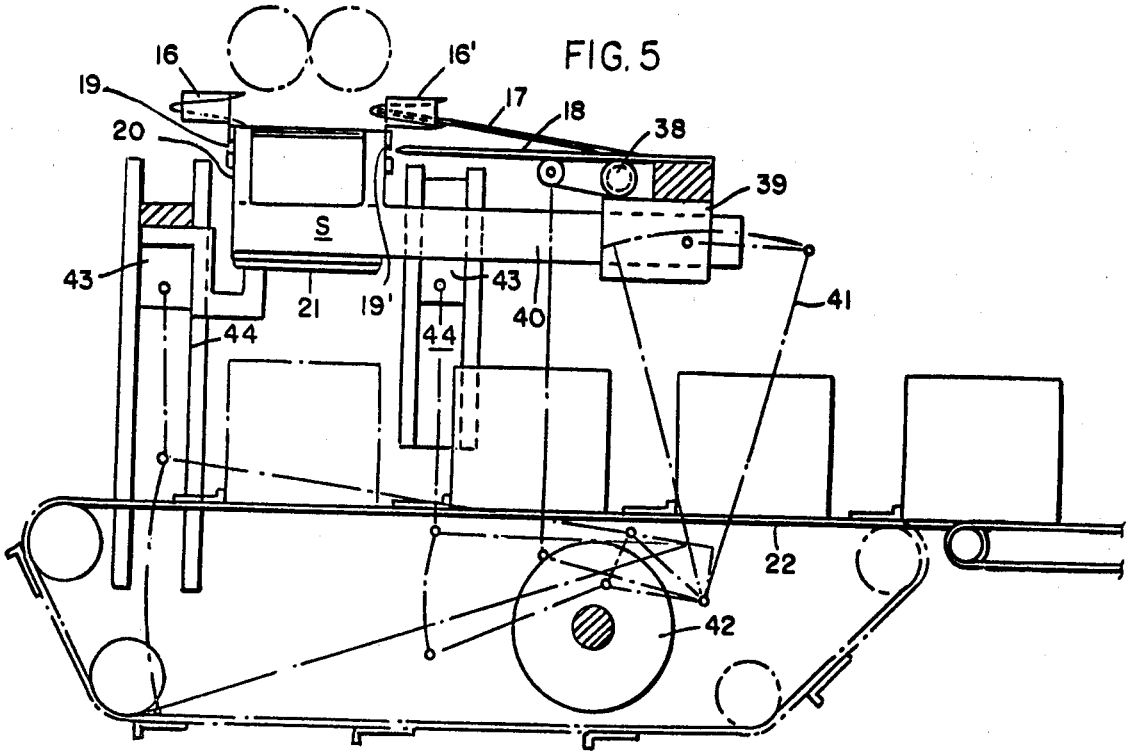

FIG. 4 is a fragmentary plan view, essentially schematic, such as would be seen along the sight line 4—4 of FIG. 1; and FIG. 5 is a fragmentary side elevational view partially in section of the folding, stacking and takeaway portions of the business form machine of FIG. 1, being in smaller scale than FIG. 1 and featuring the mechanical connections providing the movements of various elements to be described in conjunction with FIG. 1.

In the illustration given, and with reference first to FIG. 1, the numeral 10 designates generally a pin belt feed mechanism which is operative to advance a web W along a predetermined path. The web proceeds between folding members 11, 11', one being a mirror image of the other. Each member is mounted for rotation about an axis with the axes of the two members being parallel. Each member includes a gripper 12 (or 12') and a tucker 13, 13'. The members 11, 11' are in a predetermined angular orientation relative to each other so as to position the tucker 13 in web tucking engagement with the gripper 12' for folding the web W. In like fashion, the tucker 13' of the member 11' cooperates with the gripper 12 of the element 11.

Before going into the details of construction and operation of the folding members and the tuckers and grippers thereof, the remaining portion of the apparatus and method will be described to place the same in perspective.

Although the grippers are mechanically controlled, it is advantageous to provide strippers 14 and 14' which are mounted on the frame 15 of the machine in conventional fashion. These serve to disengage a fold in the web from the gripper by virtue of passing through slots (not shown) in the grippers 12, 12'. Thereafter, the draped fold D is engaged by a pair of spirals 16 or 16', as the case may be. Reference to FIG. 4 shows that a pair of spirals 16 are provided for the left hand fold while a pair of spirals 16' are provided for the adjacent right hand fold. The spirals maintain the adjacent folds about to enter the stack S in spaced apart relation permitting the introduction of a separator member 17. The separator member 17 enters between the spaced apart spirals 16' and ultimately pivots downwardly into coplanar relation with flanked apart separator plates 18 (see particularly FIGS. 4 and 5). The plates 18 enter the slot 19' in a cage 20 confining the stack S.

By the use of the spirals 16, 16', it is possible to precisely position each fold at any given time. It is also possible to insert the narrow flat pointed separator member 17 between the spirals and pivot the separator member 17 to a position below the spiral 16' for it to become part of an overall wide board consisting of the plates 18, 18' that travels downwardly and forwardly and through slot 19 until the bonds in the perforation are broken. The stack below the board made up of elements 17, 18 is supported by elevator fingers 21 (see FIG. 5) that travel downward to deposit the stack S on the conveyor 22.

As soon as the conveyor 22 has removed the stack, the elevator fingers 21 travel upward, stop and start descending at a slight increase in speed. The wide board (17, 18) above carrying a new stack descends and catches up with the elevator fingers whereupon it withdraws and moves upward for the next cycle.

Returning now to FIG. 1, the geometry of the folding members 11, 11' will now be described. As pointed out previously, the web W is advanced or fed to the folding members by means of pin belts or the equivalent via the line holes in the control margins of the web. The web, prior to being fed to the folding members 11, 11' is transversely perforated by means not shown but normally along lines that are longitudinally spaced eleven inches apart—this being the most popular size in the industry currently.

For this size of form, I can provide the distance between centers of the folding members 11, 11' (alternatively the axes of rotation) equivalent to the pitch diameters P, P' of their mating gears at six inches. The mating gears are designated 23 and 23' (see FIG. 2).

As pointed out previously, each folding member carries one gripper and one tucker. The circumferential distance between each corresponds to the normal repeat dimension of eleven inches. Thus, twenty-two inches of web travel equals one revolution of each folding member.

Each gripper is seen to include an anvil 24 or 24' and the anvil outer surface has a radious of

| | | |
|---|---|---|
| 3.500" | + | .000. |
| | − | .002 |

This radius times $2\pi$ equals a circumference of a few thousandths of an inch less than twenty-two inches. The anvils 24, 24' then extend one-half inch beyond the gear pitch line. On the other hand, the tuckers 13, 13' are well within the pitch line as specified in U.S. Pat. No. 3,195,882 to which reference may be had for additional details of construction not set forth here. For example, the actuation of the gripper elements 25 and 25' is accomplished by means of cams 26, 26' and cam followers 27, 27' in FIG. 2.

Referring again to FIG. 1, the outer surface of each anvil 24, 24' extends 50° upstream from the point where the anvil is contacted by the associated gripper element 25 or 25', as the case may be. The balance of the folding members are smaller in diameter to clear the mating anvil surface as well as the gripper element. The diameter of each folding roll is such that it confines the web against the anvil 24', 24 so that the position of the fold line is not lost.

With the folding action developed by the above described tuckers and grippers, it is not only superfluous, but undesirable to have a surplus of paper above or upstream of the engaged grippers and tuckers. This is because the outer surface of the anvil 24, 24' travels at the paper speed and the surplus needed for gripping comes from below or downstream. With folding members constructed according to my prior U.S. Pat. No. 3,195,882, the tucker hunted and found a weakness (the cross perforation) in the paper. Here, it is possible to mechanically and accurately position the tucker to the perforation. The perforation does have width and by positioning the tucker slightly downstream or upstream in relation to the perforation, the resulting folded stack may be corrected from a forward or rearward lean to square.

Figures 2, 3:
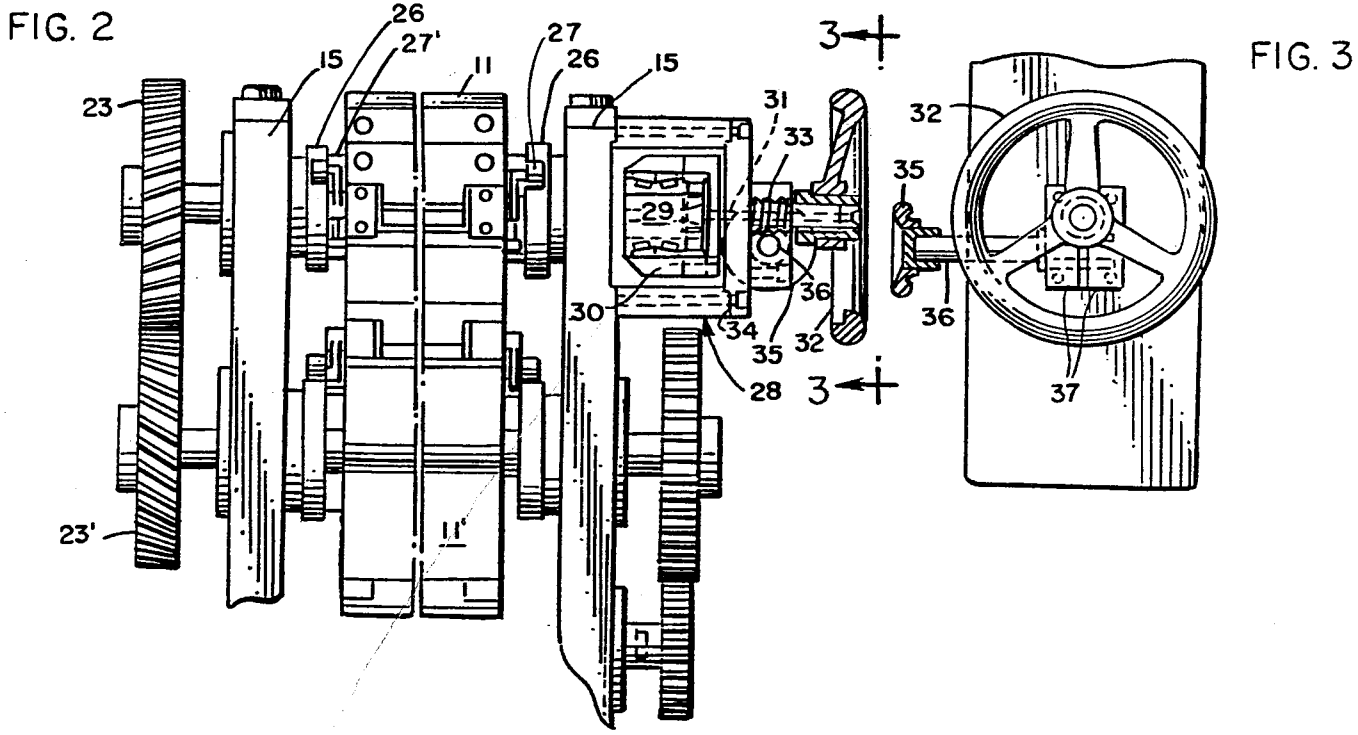
FIG. 2 is a top plan view of the folding portion of the machine of FIG. 1 and features the gearing and adjustment mechanism for eliminating stack "lean"
FIG. 3 is a side elevational view of the adjustment mechanism of FIG. 2 and such as would be seen along the sight line 3—3 applied to FIG. 2.

This correction of adjustment is achieved through the use of the helical gears 23, 23' and more particularly the adjustment means generally designated 28 in FIG. 2.

Referring now to FIG. 2, the shaft 29 of the folding member or partial roll body 11 is seen to be mounted in a movable bearing housing 30. The housing 30 is moved axially by virtue of a shaft 31 by turning the hand wheel 32 fixed thereto. The shaft 31 is supported within a threaded block 33 provided as part of an enclosure 34 secured to the frame 15. Thus, as the hand wheel 32 is turned, the shaft 31 positions the movable bearing housing 30 axially to the right or left thereby turning the folding member 11 slightly in an angular fashion because of the engagement of the helical gears 23 and 23'.

In FIG. 3, a locking mechanism is shown for the adjusting mechanism 28. This includes a hand wheel 35 which is affixed to a cross shaft 36. The cross shaft 36 operates a pair of clamping blocks 37 which engage the shaft 31 and immobilize the same against turning.

The strippers and the centrifugal force developed in the drape D (see the dashed line designations of the movement thereof in FIG. 1) cause the fold to skate tangentially along the strippers 14, 14' to the revolving spirals 16, 16'. The spirals 16, 16' turn at the same RPM as the folding rolls and in this way there is plenty of room for the next newly folded web to be deposited by a gently rolling action.

As mentioned previously, the separator member 17 pivots downwardly between the spirals 16'. This is achieved by mounting the separator member 17 on a pivot as at 38 (see FIG. 5) provided as part of the carriage 39 supporting the plates 18. As mentioned previously, the plates 18 are aligned with the slot 19 so as to pass between the folds previously separated by the separator member 17. Movement of the plates 18 to the left (as illustrated) is achieved by moving the carriage 39 along a slide 40. The slide 40 is provided as part of the cage 20 and the actuation of the carriage 39 is provided by a pivot arm illustrated schematically and designated by the numeral 41 being actuated by means of cam followers associated with a cam 42.

Movement of the cage 20 in the vertical direction is achieved by supporting the same on blocks 43 mounted in vertical ways or guides 44 which are actuated also by pivot arms actuated by the cam 42. The upper members of slot 19' are spaced apart to provide an opening for separator member 17 to pass through.

While in the foregoing specification a detailed description of an embodiment of the invention has been set down for the purpose of illustration, many variations in the details hereingiven may be made by those skilled in the art without departing from the spirit and scope of the invention.

I claim:

1. In apparatus for zig-zag folding a web wherein a web is fed between a pair of rotating folding members for travel therewith at a predetermined speed, each member having at least one tucker and one gripper, each gripper having an anvil and a movable element, said members being disposed relative to each other to position the tucker of one member in web tucking engagement with the gripper of the other member to cooperate in folding said web, means for perforating an elongated web along a plurality of longitudinally spaced apart transversely extending lines and advancing said web between said members to zig-zag fold the same into a stack, each gripper anvil having a circumferentially extending surface positioned to travel at said web given speed, and separator means positioned below said folding members including two pairs of spirals to selectively deliver developed spacing between folds, a slotted receiving cage vertically movably positioned below said spirals and having operably associated therewith a planar element having plates flanking a relatively thin separator member adapted to be interposed between a pair of spirals, and means for first inserting said separator member into said spacing and thereafter inserting said planar element into said slot to burst a perforation in said web.

* * * * *